US005479180A

United States Patent [19]

Lenzing et al.

[11] Patent Number: 5,479,180

[45] Date of Patent: Dec. 26, 1995

[54] HIGH POWER ULTRA BROADBAND ANTENNA

[75] Inventors: Erik H. Lenzing, Middletown; Harry F. Lenzing, Colts Neck; Charles D. Hechtman, Hopewell, all of N.J.

[73] Assignee: The United States of America as represented by the Secretary of the Army, Washington, D.C.

[21] Appl. No.: 217,342

[22] Filed: Mar. 23, 1994

[51] Int. Cl.[6] ..... H01R 13/04

[52] U.S. Cl. ..... 343/729; 343/772; 343/895

[58] Field of Search ..... 343/729, 772, 343/773, 767, 786, 895, 792.5; H01Q 13/04

[56] References Cited

U.S. PATENT DOCUMENTS

| | | | |
|---|---|---|---|
| 2,945,227 | 6/1960 | Broussaud | 343/895 X |
| 3,633,210 | 1/1972 | Westerman et al. | 343/895 |
| 3,681,772 | 8/1972 | Ingerson | 343/895 |
| 3,825,933 | 7/1974 | Debski et al. | 343/895 |
| 4,609,888 | 9/1986 | Corzine et al. | 343/895 X |
| 4.636,802 | 1/1987 | Middleton | 343/895 |
| 4,945,363 | 7/1990 | Hoffman | 343/895 |

*Primary Examiner*—Donald T. Hajec
*Assistant Examiner*—Steven Wigmore
*Attorney, Agent, or Firm*—Michael Zelenka; William H. Anderson

[57] ABSTRACT

A hybrid antenna in which the flared end of a parallel plate of a transmission line is coupled to a frequency independent antenna so as to take the place of the higher frequency radiating portion of the antenna.

5 Claims, 3 Drawing Sheets

HIGH POWER ULTRA BROADBAND ANTENNA

GOVERNMENT INTEREST

The invention described herein may be manufactured, used, and licensed by or for the Government of the United States of America without the payment to us of any royalty thereon.

FIELD OF THE INVENTION

This invention is in the field of broadband antennas.

BACKGROUND OF THE INVENTION

Wideband antennas are chosen from frequency independent antennas such as planar spiral, conical spiral, log-periodic, bi-conical, bow-tie antennas and Vivaldi tapers. In all of these antennas, the high frequency limit is determined by the dimension of a given portion of the structure. The smaller the dimension the higher the upper frequency limit. Unfortunately, this limits the power that can be transmitted to that at which arc-over occurs. Thus, extending the upper frequency limit by reducing the dimension of the given portions results in a reduction in the maximum power that can be transmitted.

SUMMARY OF THE INVENTION

In accordance with this invention, the flared plates of a parallel plate transmission line are coupled to a frequency independent antenna in such manner as to substitute for the portion of the antenna that determines the high frequency limit. The highest frequency that can be radiated from the flared plates has a wavelength of twice the separation between them, and since this is very small, the highest frequency can be on the order of several gigahertz. Because the flared plates can withstand considerably higher voltages than the portion of the antenna for which they are substituted, high frequencies can be radiated with much greater power. Thus a hybrid antenna is formed in which the high frequencies are radiated by the flared parallel plate transmission line and the lower frequencies are radiated by the remaining portion of the frequency independent antenna.

In a preferred embodiment of the invention the frequency independent antenna is a conical spiral that, as is well known, has spaced radiating ribbons wound around a cone, and the flared end of a parallel plate transmission line is coupled to the radiating ribbons at a point of impedance match.

BRIEF DESCRIPTION OF THE DRAWINGS

Various embodiments of the invention are described below with reference to the drawings, in which like items are indicated by the same reference designation, wherein.

DETAILED DESCRIPTION OF THE INVENTION

Figure 1:
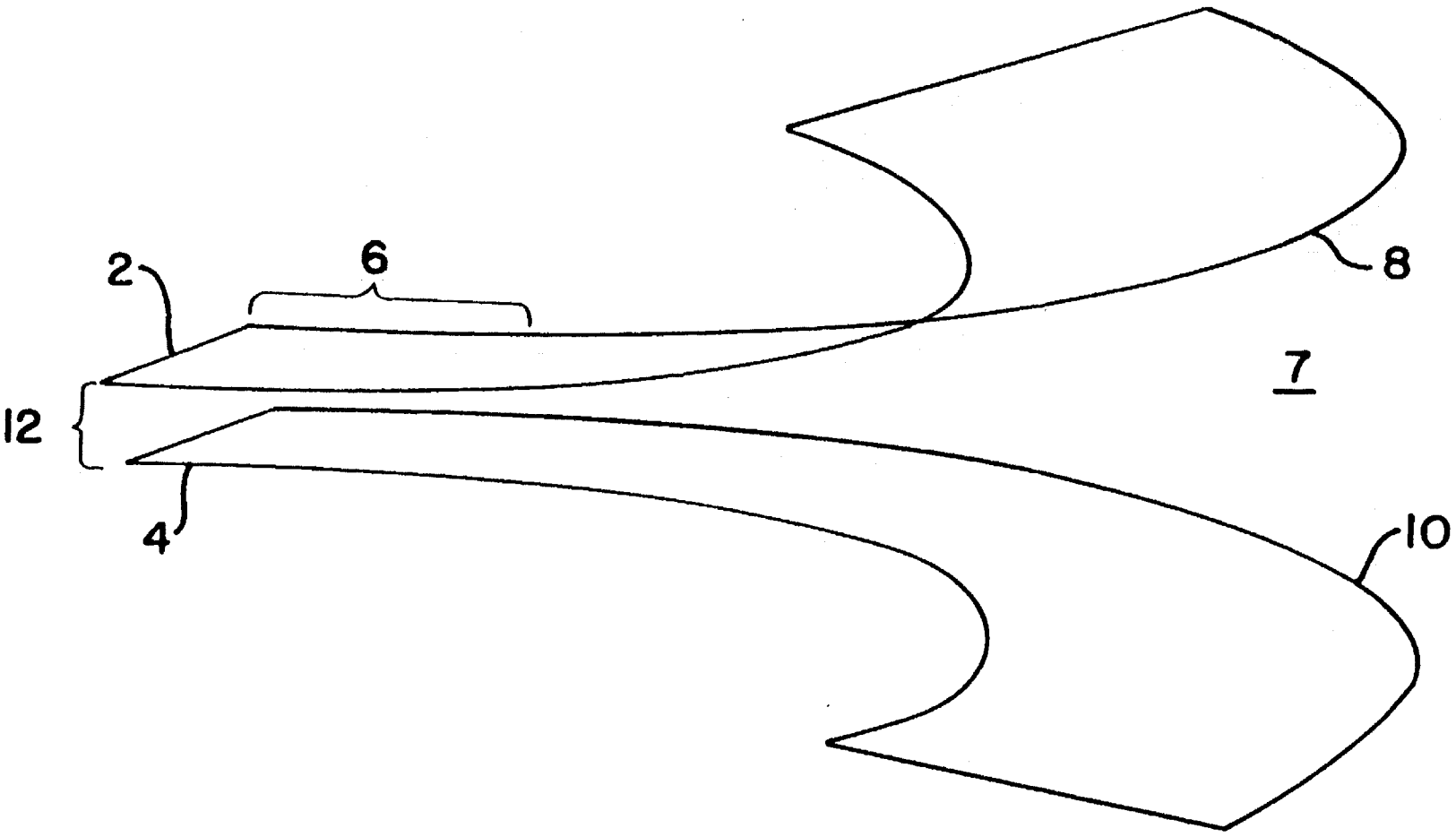
FIG. 1 is a perspective view of a flared parallel plate transmission line.

The flared transmission line high frequency radiator shown in FIG. 1 is comprised of metal plate conductors 2 and 4 that are parallel to each other in a section 6 and flare outwardly beyond that section as indicated at 7, to form two curved radiating surfaces 8 and 10 that turn backward away from the central axis toward the section 6. In order to keep the impedance the same as in section 6, the surfaces 8 and 10 become gradually wider. The space between the conductors 2 and 4 within the section 6 is indicated at 12, and although not shown, it is filled with insulating material. The shortest wavelength (corresponding to the highest frequency) that can be radiated by this structure is equal to twice the parallel plate spacing 12. Radiation from such a transmission line is minimal for lower frequencies.

Figure 2A:
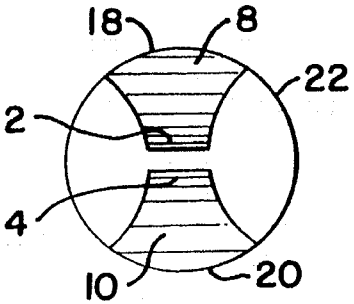
FIG. 2A is an axial view of the smaller end of the cone shown in FIG. 2.
Figure 2:
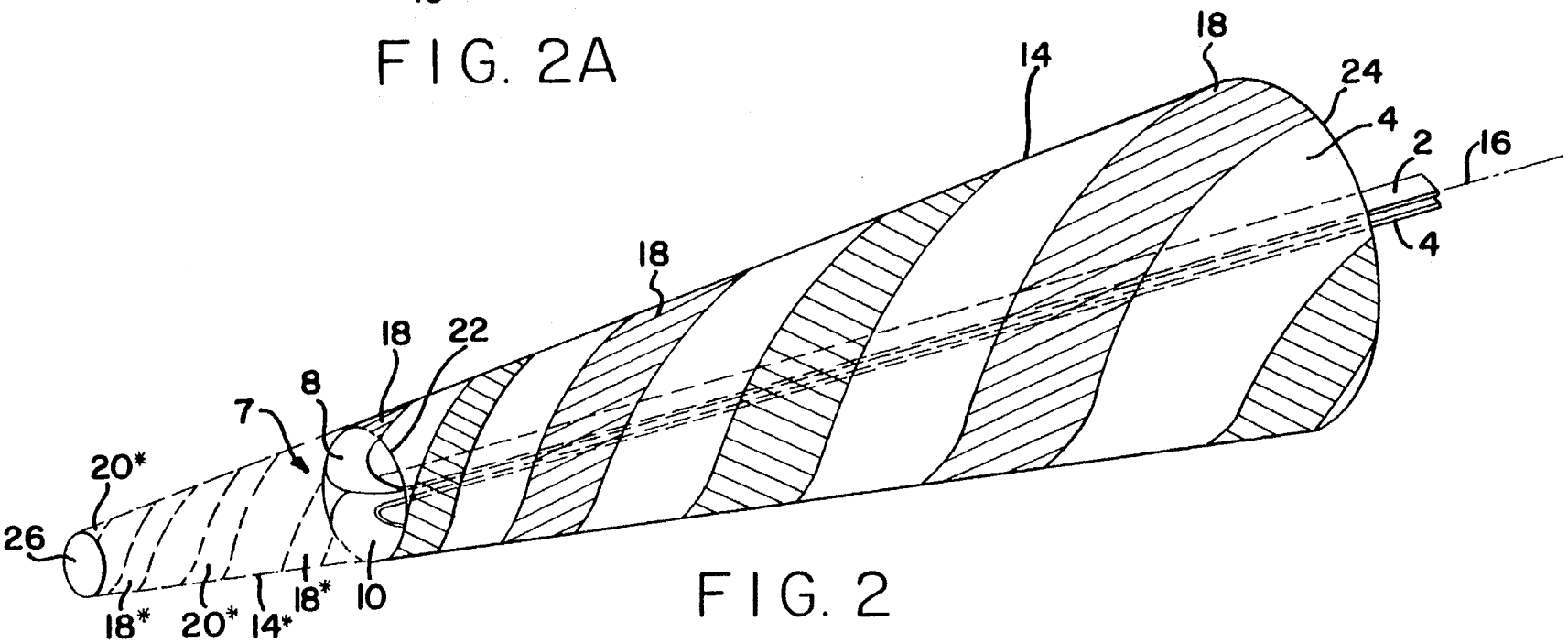
FIG. 2 is a perspective view of a preferred embodiment of the invention in which the frequency independent antenna is a spiral cone.

FIG. 2 is a perspective view of a preferred embodiment of the invention in which the frequency independent antenna is a spiral cone formed on a cone 14 having an axis 16. Spaced interleaved spiral ribbons 18 and 20 are wound about the cone 14 starting at the smaller end 22 and ending at the larger end 24. In the axial view of the smaller end of the cone 14 that is shown in FIG. 2A, it is seen that the ribbons 18 and 20 lie in opposed arcs of 90° so that there are 90° arcs between them. When the radiating ribbons 18 and 20 are formed on a flat sheet as will be explained by reference to FIG. 3, they will occupy opposed 90° arcs in any circle formed at the intersection of the cone 14 and a plane perpendicular to its axis 16. Of course, the positions of these arcs will rotate about the axis 16 as the plane referred to moves from the smaller end 22 of the cone 14 to its larger end 24.

As shown in FIG. 2, the transmission line formed by the parallel plates 2 and 4 extends along the axis 16, and the curved back radiating surfaces 8 and 10 are respectively connected to the radiating ribbons 18 and 20 at the smaller end 22 of the cone 14. The impedance between the ribbons 18 and 20 increases from the smaller end 22 to the larger end 24 and is the same at the point of connection to the surfaces 8 and 10 as the impedance of the transmission line 2, 4.

If a spiral cone antenna using the cone 14 and the radiating ribbons 18 and 20 were to have the same upper frequency limit as that obtained by the structure utilizing the transmission line 2, 4, the cone 14 and the ribbons 18 and 20 would have to be extended as indicated at 14*, 18* and 20* by dashed lines so that the arcs occupied by the extended ribbons 18* and 20* on the circular end 26 of the cone extension 14* would be much closer together than the arcs that they occupy on the end 22. This would reduce the power that could be transmitted because of arc-over. Thus, in effect, the flared transmission line formed by the plates 2 and 4 and their flared ends 8 and 10 replaces the extension indicated in dashed lines.

Figure 3:
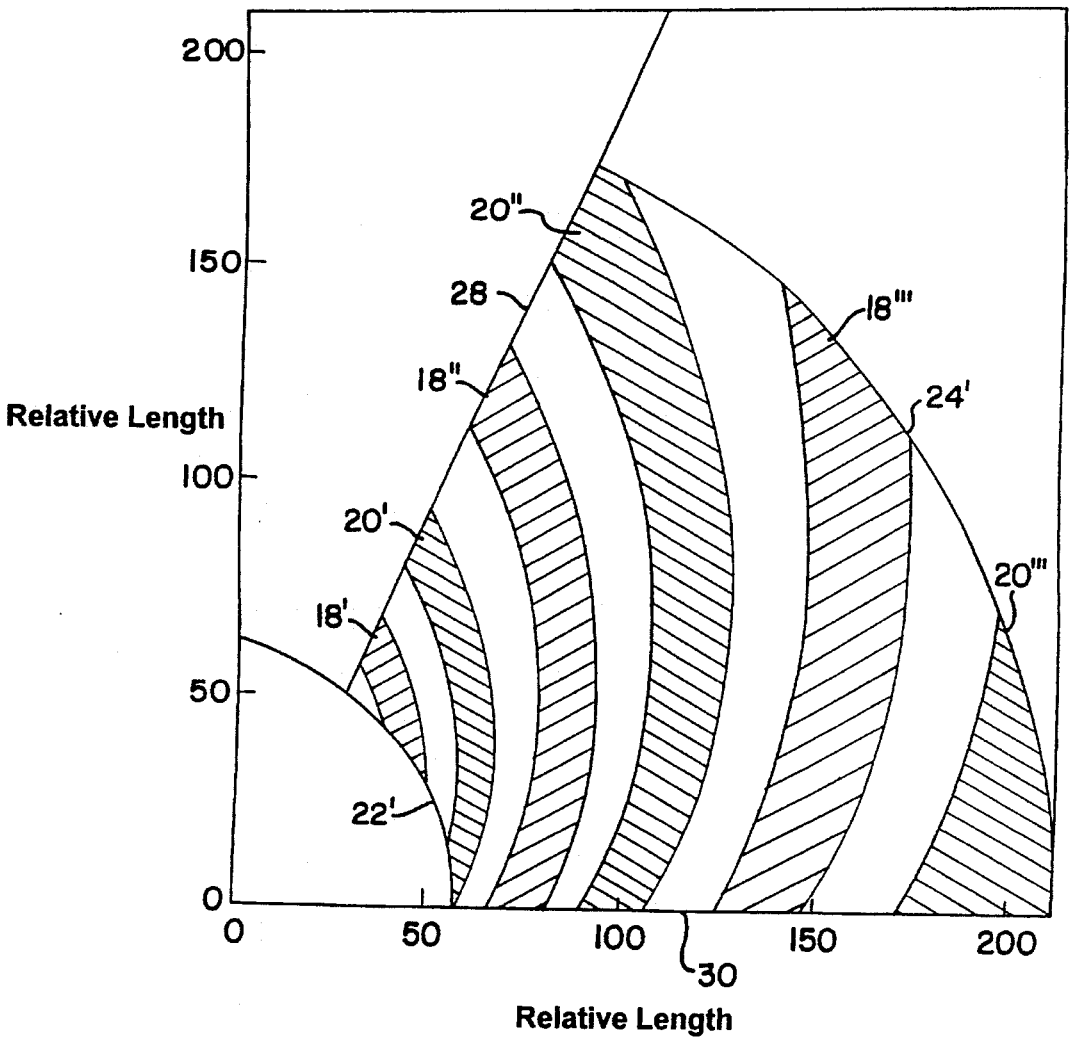
FIG. 3 shows a pattern for forming the radiating ribbons of FIG. 2.

FIG. 3 shows a flat pattern for the radiating ribbons 18 and 20 that can be rolled into the conical form shown in FIG. 2. In order to avoid confusion, certain components of FIG. 3 that form parts of FIG. 2 are designated by the same numbers primed. Thus the smaller end 22 of the cone 14 in FIG. 2 is formed by the curved edge 22' in FIG. 3, and the larger end 24 is formed by the curved edge 24'.

The ribbon 18 of FIG. 2 is formed by sections 18', 18", and 18''' in FIG. 3, and the ribbon 20 of FIG. 2 is formed by sections 20', 20" and 20''' of FIG. 3 When the pattern of FIG. 3 is rolled up into a cone, its edge 28 is joined to its edge 30, and the end of a section for a given ribbon that is at the edge 28 is joined to the end of the next outer section for the same ribbon that is at the edge 30. Thus, the end of the section 18' that is at the edge 28 is joined to the end of the section 18" that is at the edge 30, and so forth.

Note that each of the ends of the sections 18' and 20' that are at the curved edge 22' are equal to one quarter of the edge 22' and that like spaces are on either side as is required for the ribbons 18 and 20 of FIG. 2 to occupy opposed arcs of 90° at the smaller end 22 of the cone 14. In order to keep this same relationship at the intersection of the cone 14 and any plane perpendicular to its axis 16, as previously stated, the sections of each ribbon must increase in width as shown.

Although various embodiments of the invention have been shown and described herein, they are not meant to be limiting. Those of skill in the art may recognize certain modifications to these embodiments, which modifications are meant to be covered by the spirit and scope of the appended claims.

What is claimed is:

1. A hybrid antenna comprising:

a frequency independent antenna comprising at least first and second radiating members;

a parallel plate transmission line having at least first and second plate conductors that are parallel to a central axis, said first and second plate conductors having at least first and second radiating surfaces which are flared to be wider than the first and second plate conductors, which are curved backward, rearward and away from the central axis, and which radiate energy at predetermined frequency and wavelength; and wherein the first and second radiating surfaces of the first and second plate conductors are respectively coupled to said frequency independent antenna.

2. A hybrid antenna as set forth in claim 1, wherein said frequency independent antenna is a conical spiral.

3. A hybrid antenna as set forth in claim 1, wherein the first and second radiating members of said frequency independent antenna and the first and second radiating surfaces of said transmission line are joined in such a manner as to reduce reflection.

4. A hybrid antenna as set forth in claim 1, wherein the first and second radiating members and the first and second plate conductors are respectively coupled so as to be impedance matched.

5. A hybrid antenna comprising:

a frequency independent antenna having a portion responsive to lower frequencies, the frequency independent antenna comprising at least first and second radiating members which spiral downward in the shape of a truncated cone; and a parallel plate transmission line having at least first and second plate conductors that are parallel to a central axis, said first and second plate conductors having at least first and second radiating surfaces which are flared to be wider than the first and second plate conductors and are curved backward, rearward and away from the central axis, and which radiate energy at predetermined frequency and wavelength;

wherein the first and second radiating surfaces of the first and second plate conductors are respectively coupled to the first and second radiating members so as to be responsive to higher frequencies.

* * * * *